US012180822B2

(12) United States Patent
Revheim et al.

(10) Patent No.: US 12,180,822 B2
(45) Date of Patent: Dec. 31, 2024

(54) SYSTEM AND METHOD TO PREDICT VALUE AND TIMING OF DRILLING OPERATIONAL PARAMETERS

(71) Applicant: Exebenus AS, Sandnes (NO)

(72) Inventors: Olav Revheim, Sandnes (NO); Alexander Chekushev, Sandnes (NO); Dalila Gomes, Sandnes (NO)

(73) Assignee: Exebenus AS, Sandnes (NO)

( * ) Notice: Subject to any disclaimer, the term of this patent is extended or adjusted under 35 U.S.C. 154(b) by 702 days.

(21) Appl. No.: 17/205,063

(22) Filed: Mar. 18, 2021

(65) Prior Publication Data

US 2021/0293130 A1 Sep. 23, 2021

Related U.S. Application Data

(60) Provisional application No. 62/991,777, filed on Mar. 19, 2020.

(51) Int. Cl.

| | |
|---|---|
| ***E21B 44/08*** | (2006.01) |
| ***E21B 45/00*** | (2006.01) |
| ***E21B 47/022*** | (2012.01) |

(52) U.S. Cl.

CPC ..... *E21B 45/00* (2013.01); *E21B 44/08* (2013.01); *E21B 47/022* (2013.01); *E21B 2200/20* (2020.05)

(58) Field of Classification Search

CPC ..... E21B 45/00; E21B 44/00; E21B 44/08; E21B 2200/20; E21B 2200/22; E21B 47/00; E21B 47/022; E21B 47/0232; E21B 47/007; E21B 47/003; E21B 47/008; E21B 47/02; E21B 47/024; E21B 41/00; E21B 41/0007; E21B 49/003; E21B 49/006; E21B 49/087; E21B 7/04; E21B 7/10; E21B 12/02; G01P 15/00; G01P 15/0891; G01P 3/50; G01P 3/00; G05B 2219/45129; G06N 20/00; G06N 7/01; G06N 3/08; G06N 3/02; G06N 3/09; G06N 5/022; G01V 1/40

USPC ..... 73/861.356, 152.03, 152.43; 700/108; 702/9, 182, 183, 188, 189, 185, 150, 34, (Continued)

(56) References Cited

U.S. PATENT DOCUMENTS

| | | | | |
|---|---|---|---|---|
| 9,175,557 | B2 | 11/2015 | Iversen et al. | |
| 10,062,044 | B2 * | 8/2018 | Hildebrand | E21B 7/04 |

(Continued)

FOREIGN PATENT DOCUMENTS

| | | | | |
|---|---|---|---|---|
| WO | WO-2015123591 | A1 * | 8/2015 | E21B 41/0007 |
| WO | WO-2016182799 | A1 * | 11/2016 | E21B 41/00 |
| WO | WO-2021073776 | A1 * | 4/2021 | E21B 47/07 |

OTHER PUBLICATIONS

B. S. Aadnoy, Larsen K., & Berg, P.C., 2002. Analysis of stuck pipe in deviated boreholes. Journal of petroleum science and engineering (37) 195-212. doi:10.1016/S0920-4105(02)00353-4.

(Continued)

*Primary Examiner* — Jeffrey P Aiello

(74) *Attorney, Agent, or Firm* — Casimir Jones, S.C.; Brian F. Bradley

(57) ABSTRACT

A method and a system for using machine learning technologies to predict the value and timing of operational parameters. These predictions are then used to identify the risk of certain well incidents to occur, and if so notify responsible personnel thereof as to allow preventive actions to be taken.

26 Claims, 16 Drawing Sheets

(58) Field of Classification Search
USPC .. 702/184, 141, 56, 181, 127, 187, 6, 85, 1, 702/33, 190, 43; 703/2, 10, 6, 7, 1
See application file for complete search history.

(56) References Cited

U.S. PATENT DOCUMENTS

| | | | | |
|---|---|---|---|---|
| 11,275,488 | B2 * | 3/2022 | Bettles | G06N 20/20 |
| 2006/0037781 | A1 * | 2/2006 | Leuchtenberg | E21B 44/00 175/48 |

OTHER PUBLICATIONS

Dupriest, F. E., Elks, W. C., & Ottesen, S., 2011. Design Methodology and Operational Practices Eliminate Differential Sticking. Society of Petroleum Engineers. pp. 115-123 doi:10.2118/128129-PA.
Muqeem, M. A., Weekse, A. E., & Al-Hajji, A. A., 2012. Stuck Pipe Best Practices—A Challenging Approach to Reducing Stuck Pipe Costs. Society of Petroleum Engineers. SPE-160845. 10 pages doi:10.2118/160845-MS.
Santos, H., 2000. Differentially Stuck Pipe: Early Diagnostic and Solution. Society of Petroleum Engineers. IADC/SPE 59127. 5 pages doi:10.2118/59127-MS.
Bjerke, H. (2013). Revealing Causes of Restrictions by Signatures in Real-Time Hook Load Signals. NTNU—Department of Petroleum and Applied Geophysics. 120 pages.
Ferreira, E. J. S., 2012. Hole Cleaning Performance Monitoring During The Drilling of Directional Well. Master thesis, Lisbon University. 102 pages.
Kristensen, E. (2013). Model of Hook Load During Tripping Operation. Trondheim: NTNU Department of Petroleum and Applied Geophysics. 84 pages.
Mkuyi, F. R., 2016. Evidences of Poor Hole-cleaning or of Wellbore Instability Through Hook Load Response. Thesis, NTNU. 86 pages.
Sjoberg, A.S. , 2014. Building, Testing and Qualifying New Hook Load Rig. NTNU—Department of Petroleum and Applied Geophysics. 106 pages.
Cayeux, Eric, Mathematical Modelling of the Drilling Process for Real-time Applications in Drilling Simulation, Interpretation and Assistance by Eric Cayeux. Stavanger : University of Stavanger, 2020 (PhD thesis UiS, No. 506) 423 pages.
Hastie, T. et al. The Elements of Statistical Learning: Data Mining, Inference, and Prediction, Springer, 2009, 745 pages, Table of Contents Only.
Boznar, M. et al. Neural Networks—A New Mathematical Tool For Air Pollution Modelling, WIT Transactions on Ecology and the Environment, 1995, vol. 9, 8 pages.
Suresh, P.V. et al. Artificial Neural Network Approach For Multiple Fault Diagnosis: A Case Study, WIT Transactions on Information and Communication Technologies, 1994, vol. 6, 10 pages.

* cited by examiner

SYSTEM AND METHOD TO PREDICT VALUE AND TIMING OF DRILLING OPERATIONAL PARAMETERS

CROSS-REFERENCE TO RELATED APPLICATIONS

This application claims priority to U.S. Provisional Patent No. 62/991,777 filed on Mar. 19, 2020, the entire contents of which are incorporated herein by reference.

TECHNICAL FIELD

The present disclosure relates generally to oil and gas well drilling and well operations, including injection and waste wells throughout the lifetime of the well. More specifically, this disclosure relates to a method and a system using machine learning models to predict incidents in well operations.

BACKGROUND

Drilling and well operations in oil and gas wells are expensive operation. The cost is typically several tens to several hundred thousand dollars per day, and a failed operation may ruin the wells production. These operations are also prone to a high percentage of non-productive time, often in the range of 10 to 20% of the total operations time. Some of this non-productive time also pose risk for injuries, loss of life, and damage to the environment.

SUMMARY

In some embodiments, the disclosure provides a method for predicting an event in oilfield operations. The method includes receiving time-based data from a real-time data system including a sensor, filtering the time-based data from the sensor, and generating, using a machine learning model, a prediction based on the filtered time-based data from the sensor. The prediction includes a predicted time and a predicted value. The method further includes comparing the prediction with a trigger threshold to predict when the event will occur.

In some embodiments, the disclosure provides a system for predicting an event in oilfield operations including a real time data system associated with at least one oil well, an electronic processor, and a memory. The memory storing instructions that when executed by the electronic processor configure the electronic processor to receive data from the real time data system, filter the data received from the real time data system, generate a time prediction and a value prediction using a machine learning model based on the filtered data, and compare the time prediction and the value prediction with a trigger threshold to predict when the event will occur.

Other aspects of the disclosure will become apparent by consideration of the detailed description and accompanying drawings.

Figure 1:
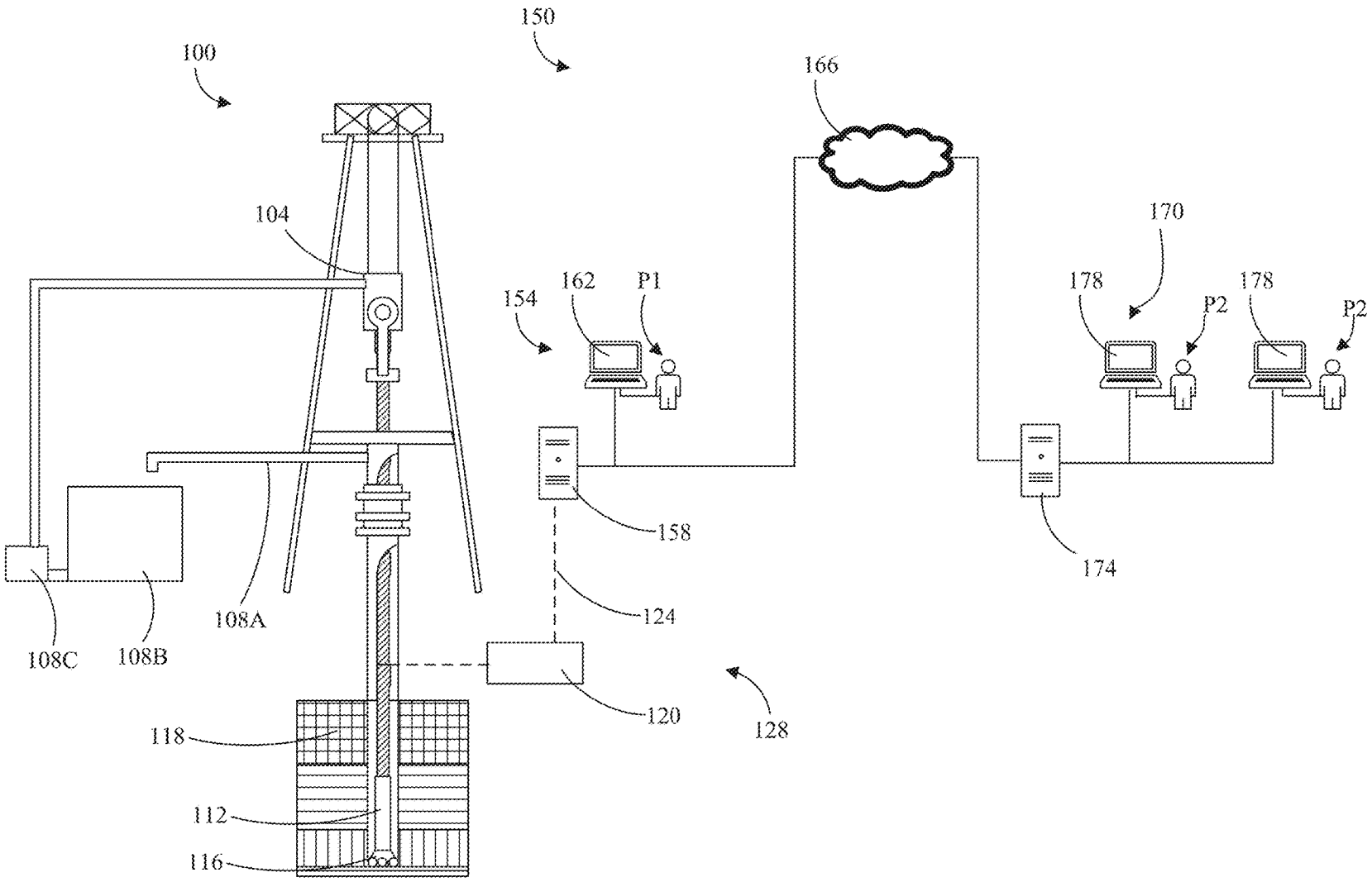
FIG. 1 is a schematic diagram of an oil well and a computer system.

Before any embodiments are explained in detail, it is to be understood that the invention is not limited in its application to the details of construction and the arrangement of components set forth in the following description or illustrated in the following drawings. The invention is capable of other embodiments and of being practices or of being carried out in various ways.

DETAILED DESCRIPTION

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

In addition, it should be understood that embodiments may include hardware, software, and electronic components or modules that, for purposes of discussion may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software-based devices, as well as a plurality of different structural components, may be utilized to implement the embodiments. For example, "servers" and "computing devices" described in the specification can include one or more processing units, one or more computer-readable medium modules, one ore more input/output interface, and various connections (e.g., a system bus) connecting the components.

With reference to FIG. 1, a drilling rig 100 or other well operating units (e.g., a workover rigs, a coiled tubing unit, a wireline unit) includes rig equipment 104 (e.g., a block), a mud pump system 108A, 108B, 108C, a drill string 112 (i.e., downhole equipment), and a drill bit 116 for drilling rock 118. As explained herein, to minimize the non-productive times, the operation of the drilling rig 100 is monitored by a sensor 120 coupled to a portion of the rig 100. In some embodiments, more than one sensor is coupled to the drilling rig 100. An output 124 of the sensor 120 is provided to a computer system 150. The output 124 of the sensor 120 includes data that can provide insights in the operations of the rig 100 and the various types of rock 118 being drilled through. In some embodiments, the sensor 120 is a hook load sensor, a torque sensor, a mud density input sensor, a mud flow input sensor, a pressure sensor, a rotations per minute (RPM) sensor, an equivalent circulating density (ECD) sensor, a rate of penetration (ROP) sensor, a drill depth sensor, or any other suitable sensor.

The output 124 from the sensor 120 (i.e., sensor output data) is captured as part of a real-time data system 128 that then stores the output 124 in a drill site computer 154. The drill site computer 154 is typically located on the premises of the drilling rig 100. In the illustrated embodiment, the drill site computer 154 includes a memory storage 158 and a display 162. In some embodiments, the output 124 from the sensor 120 is shown on the display 162 and can be monitored by qualified personnel P1 to verify the quality of operations and to identify deviations or early warnings for undesired events.

With continued reference to FIG. 1, the output 124 from the sensor 120 captured and stored in the computer storage 1158 is also distributed via a network 166. In some embodiments, the network is internet-based. The sensor data 124 is distributed by the network 166 to one or more remote locations 170 outside from the drilling rig 10 (e.g., a remote office buildings). In some embodiments, the sensor data is stored as time or depth series of data at the remote locations 170 on computer storage 174 and shown on displays 178 to other qualified personnel P2.

The network 166 is, for example, a wide area network ("WAN") (e.g., a TCP/IP based network), a local area network ("LAN"), a neighborhood area network ("NAN"), a home area network ("HAN"), or personal area network ("PAN") employing any of a variety of communications protocols, such as Wi-Fi, Bluetooth, ZigBee, etc. In some embodiments, the network 166 is a cellular network, such as, for example, a Global System for Mobile Communications ("GSM") network, a General Packet Radio Service ("GPRS") network, an Evolution-Data Optimized ("EV-DO") network, an Enhanced Data Rates for GSM Evolution ("EDGE") network, a 3GSM network, a 4GSM network, a 5G New Radio, a Digital Enhanced Cordless Telecommunications ("DECT") network, a digital AMPS ("IS-136/TDMA") network, or an Integrated Digital Enhanced Network ("iDEN") network, etc.

Figure 1A:
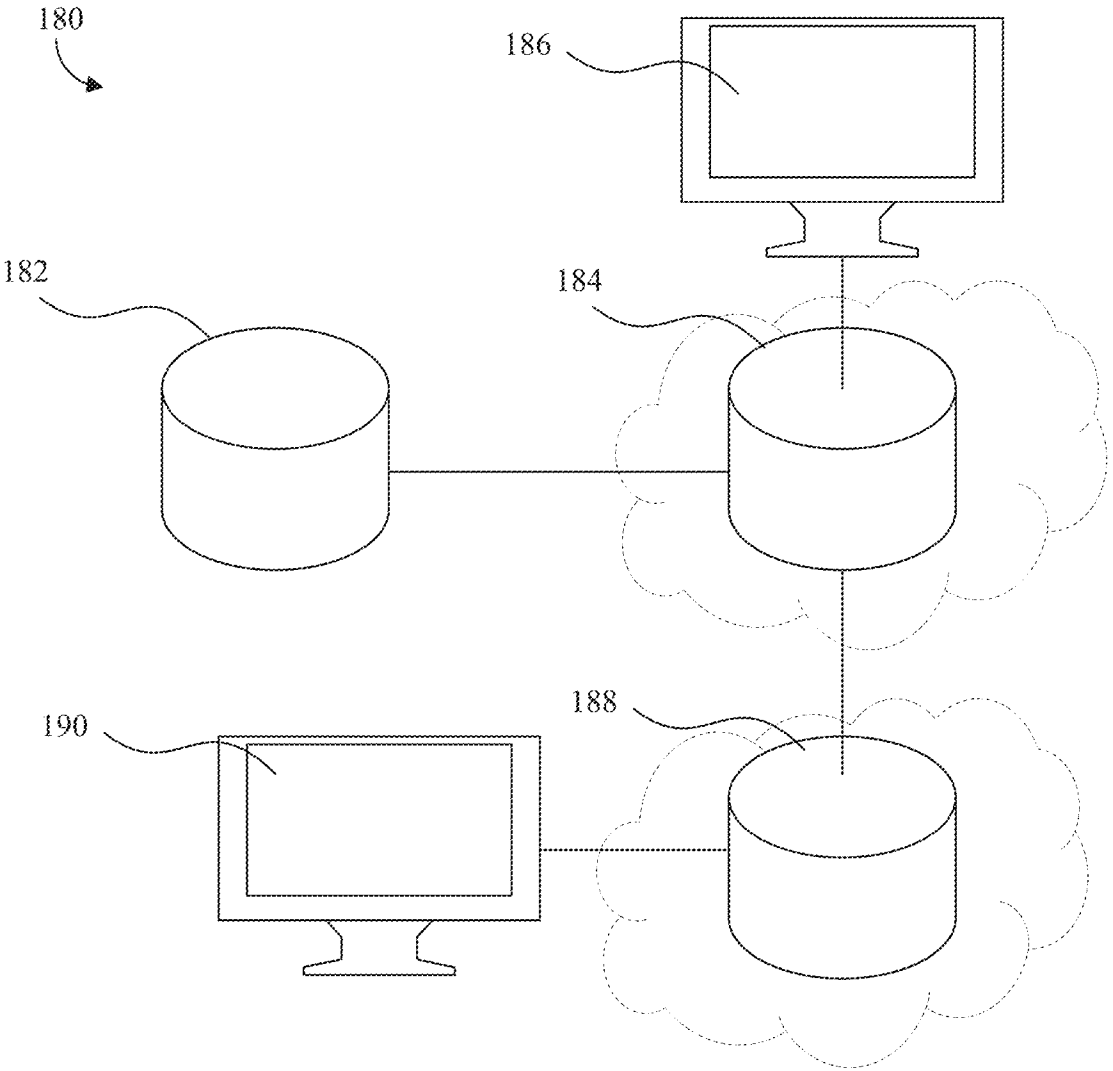
FIG. 1A is a schematic diagram of a computer system.
Figure 14:
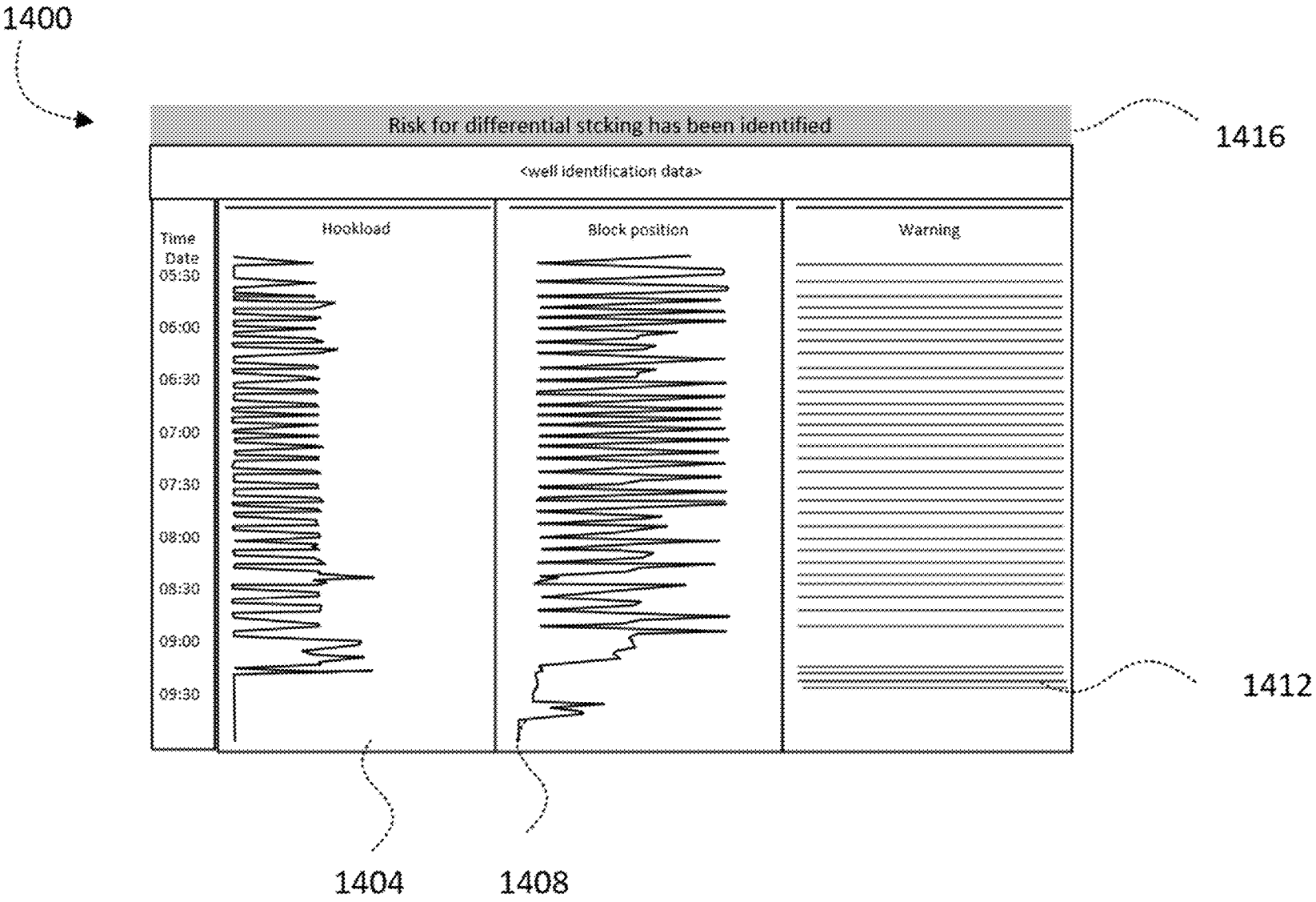
FIG. 14 is a user display illustrating two time series curves corresponding to sensor data and corresponding warnings.

With reference to FIG. 1A, a computer system 180 according to some embodiments is illustrated. Data 124 from the sensor 120 may be pulled via any conventional data transfer protocol from the real time data acquisition, storage and distribution computer 182 (e.g., the drill site computer 154) to a processing computer 184, where predictive methods are performed. Mapping and configuration of data series mnemonics are performed on a configuration user interface via a web interface 186. In some embodiments, the processing computer 184, may be cloud hosted. The actual predictive modelling can be done on a separate, preferably cloud hosted system 188, such as Microsoft Azure, IBM Watson or other commercially available machine learning/artificial intelligence systems. The individual predictive models are designed, set up and trained in a web interface 190 connected to the machine learning/artificial intelligence systems 188. The individual predictive models are stored in the system 188. The output from the individual predictive model(s) are retrieved by the processing computer 184, where the input from the predictive model(s) are selected, compared with the success/failure criteria (i.e., trigger thresholds) and converted to a time series data stream. The data can then be viewed on a web-based user interface, such as the interface 1400 shown in FIG. 14. In particular, interface 1400 displays two time series curves 1404, 1408 corresponding to sensor data, corresponding warnings 1412, and a text warning 1416 based on the same.

As used herein, the computers (e.g., computers 152, 170, 184, 188) includes a plurality of electrical and electronic components that provide power, operational control, and protection to the components and modules within the computers and/or the system. For example, the processing computer 184 includes, among other things, a processing unit (e.g., a microprocessor, a microcontroller, or other suitable programmable device), and is implemented using a known computer architecture (e.g., a modified Harvard architecture, a von Neumann architecture, etc.).

The memory storage of the computers (e.g., storage 158, 174) is a non-transitory computer readable medium and includes, for example, a program storage area and the data storage area. The program storage area and the data storage area can include combinations of different types of memory, such as a ROM, a RAM (e.g., DRAM, SDRAM, etc.), EEPROM, flash memory, a hard disk, a SD card, or other suitable magnetic, optical, physical, or electronic memory devices. The processing unit is connected to the memory and executes software instructions that are capable of being stored in a RAM of the memory (e.g., during execution), a ROM of the memory (e.g., on a generally permanent bases), or another non-transitory computer readable medium such as another memory or a disc. Software included in the implementation of the methods disclosed herein can be stored in the memory. The software includes, for example, firmware, one or more applications, program data, filters, rules, one or more program modules, and other executable instructions.

For example, the processing computer 184 is configured to retrieve from the memory and execute, among other things, instructions related to the processes and methods described herein.

As explained further herein, the present disclosure provides a method and a system for using machine learning systems to predict values and compare the predicted values with trigger thresholds (i.e., success or failure criteria). Warnings are provided in a data display system, and allows qualified personnel to intervene in the operations of the well 100 to ensure a successful outcome. Being able to accurately make early predictions, whether potentially successful or failed operations, is valuable, as it allows qualified personnel to intervene early into the operations to secure a successful outcome of the operations.

As described in further detail herein, the disclosure provides a method and system for capturing sensor data from a real time, or historical time and/or depth based data stream from an oil rig or similar unit related to drilling, completion and intervention activities in the oil and gas field. The method and system will filter and normalize these data and feed them to one or more predictive machine learning models to provide predicted time and/or depth data series. The predicted data series is then compared to a predefined rule based or modelled success/failure criteria. In case the predefined criteria are met the alarms are generated. Both the predicted data and the alarms are converted to a time and/or depth based data series which are stored and displayed on a computer system, thus enabling qualified personnel to intervene in drilling and well operations to secure a successful drilling, completion or intervention operations.

There are various events that occur during drilling operations and the methods and systems described herein predict when those events may occur. In other words, the methods (e.g., method 300) and systems (e.g., systems 400, 500, 600) described herein predict events in oilfield operations. In some embodiments, the event is differential sticking (FIG. 2A), a stuck pipe due to wellbore geometry issues (FIG. 2B), or a hole cleaning issue (FIG. 2C).

Figure 2A:
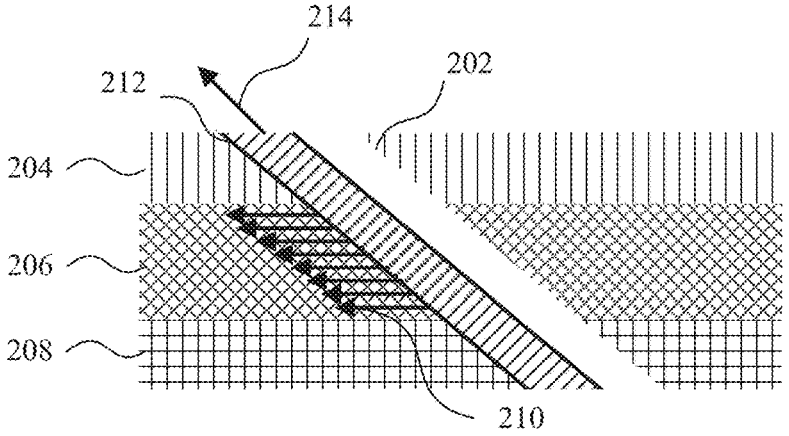
FIG. 2A is a schematic illustrating a differential sticking event.

With reference to FIG. 2A, one potential event (e.g., an operational failure mode) is differential sticking, which is caused by a pressure overbalance in a wellbore 202 relative to the rock formations 204, 204, 208 penetrated by the wellbore 202. In permeable rock formations 206, the overbalance can create a suction force 210 that pulls a pipe 212 positioned in the wellbore 202 towards the rock formation 206. When the suction forces 210 is greater than the available pull force 214 that can be generated by the rig 100, the pipe 212 is stuck in the wellbore 202 (i.e., differential stuck). Differential sticking gives a static friction that can be seen as an abnormal hook load and/or torque reading.

Figure 2B:
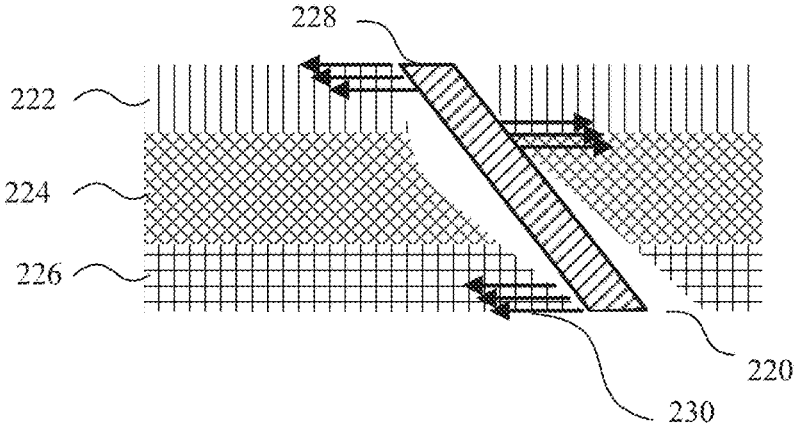
FIG. 2B is a schematic illustrating a wellbore geometry issue event.

With reference to FIG. 2B, another potential event is an issue (e.g., stuck pipe) due to a complex wellbore geometry. One of ordinary skill in the art is familiar with other failure modes caused by complex well geometry. The wellbore 220 penetrates rock formations 222, 224, 226 and may have a curved or arcuate shape. In the curved sections of the wellbore 220, the pipe 228 contacts the rock enclosing the wellbore 220, thereby creating friction forces 230 between the rocks 222, 224, 226 and the pipe 228. The pipe 228 can become stuck in the wellbore 220 when the friction forces 230 created between the pipe 228 and the rocks 222, 224, 226 exceeds the power of the rig 100.

Figure 2C:
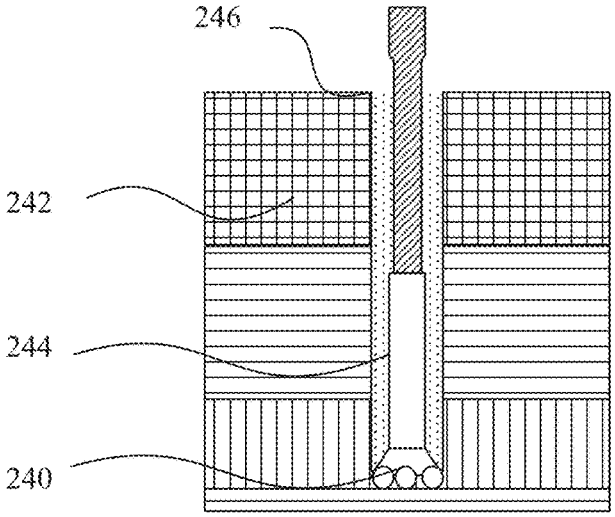
FIG. 2C is a schematic illustrating a hole cleaning event.

With reference to FIG. 2C, another potential event is an issue (e.g., stuck pipe) due to poor hole cleaning. During normal drilling operations, a drill bit 240 drills through rock formations 242 and is extended by a pipe 244. As the drill bit 240 drills through the rock formations 242, small rock fragments (i.e., cuttings) are loosened and circulated to a surface 246 via mud. In the event that the circulation of mud is inadequate to remove the cuttings from the well, the cuttings can accumulate and give rise to poor hole cleaning, which may cause the pipe 244 to become stuck.

Figure 3:
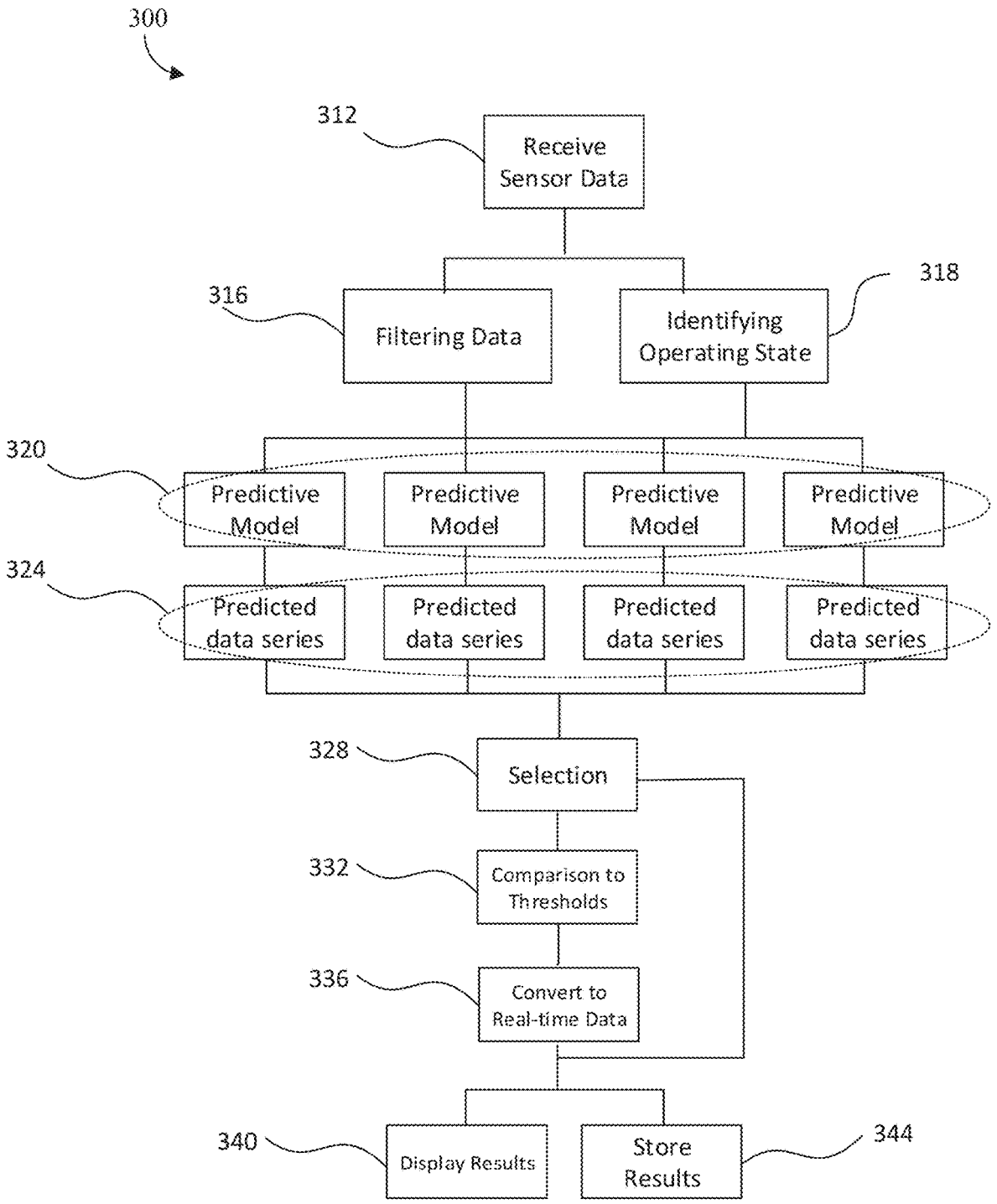
FIG. 3 is a machine learning method for predicting an event.

With reference to FIG. 3, a machine learning method 300 is illustrated for predicting the occurrence of an event (e.g., the events illustrated in FIGS. 2A-2C) in oilfield operations. The method 300 includes STEP 312 of receiving time-based data from the sensors and gathered in via a data acquisition, storage and distribution system. In some embodiments, the data is received as time or depth series of data. The sources of such data can be WITSML data, WITSO data, OPC data or other data formats. STEP 312 of receiving the data can include in some embodiments, reading such data series in a data receptor module that connects to the data source and configuration of data mnemonics for the relevant sensor data series. In some embodiments, each different data format includes a corresponding unique data receptor module. In some embodiments, STEP 312 of receiving time-based data is performed at a processor remote from the oil well location. Next, the method 300 also includes STEP 316 that filters the time-based data received from the sensors. After receiving the data (STEP 312), the data is pre-processed and filtered by filtering and normalization algorithms in STEP 316. The filtering at STEP 316 eliminates irrelevant an undesired data, and different filtering methods are used for the different data series. See, for example, FIG. 7.

In some embodiments, the method 300 includes a STEP 318 of identifying an operating state based on the time-based data from the sensor. The operation state may be one of the following states: a drilling state, a non-drilling state, a tripping-in state, a tripping out state, a reaming state, a sliding state, and a circulating state. As explained in greater detail herein, identifying the operating state can be utilized to select which predictive models to utilize in later steps of the method 300.

With continued reference to FIG. 3, the method 300 includes STEP 320 of predicting values using machine learning models. In other words, at STEP 320 includes generating, using a machine learning model, a prediction based on the filtered time-based data from the sensor, wherein the prediction includes a prediction time and a prediction value. In some embodiments, the machine learning models are random forest, regression analysis and neural network predictive models, and other commercially available predictive models. After filtered data is inputted to the models at STEP 320, a prediction is received from the machine learning models at STEP 324. The output of each model is a series of predicted values presented in a time series. The output values are still normalized at this stage but can be reverted to sensor values. The method 300 may include multiples STEP 320 and STEP 324 for more than one model.

At STEP 328, selection of the model that shows the closest proximity to the actual values is selected by a selection algorithm (i.e., determine a preferred model and preferred prediction). At STEP 332, the predicted data series are then compared to known success/failure pattern for different scenarios (i.e., trigger thresholds) that identify risk of events occurring (e.g., differential sticking). In other words, STEP 332 includes comparing the prediction with the trigger threshold to predict when the event will occur. As such, the method 300 generates a prediction and compares the prediction with a trigger threshold to predict if an event will occur. The selected prediction data series from the predictive models in STEP 320 and the risk identification evaluation in STEP 332 is converted at STEP 336 to time series data, which can be displayed to a user as a time series data plot at STEP 340 or stored in data storage (e.g., a WITSML server) at STEP 344. In some embodiments, STEP 340 includes generating a warning that the event may happen when the prediction satisfies the trigger threshold (at STEP 332).

Figure 4:
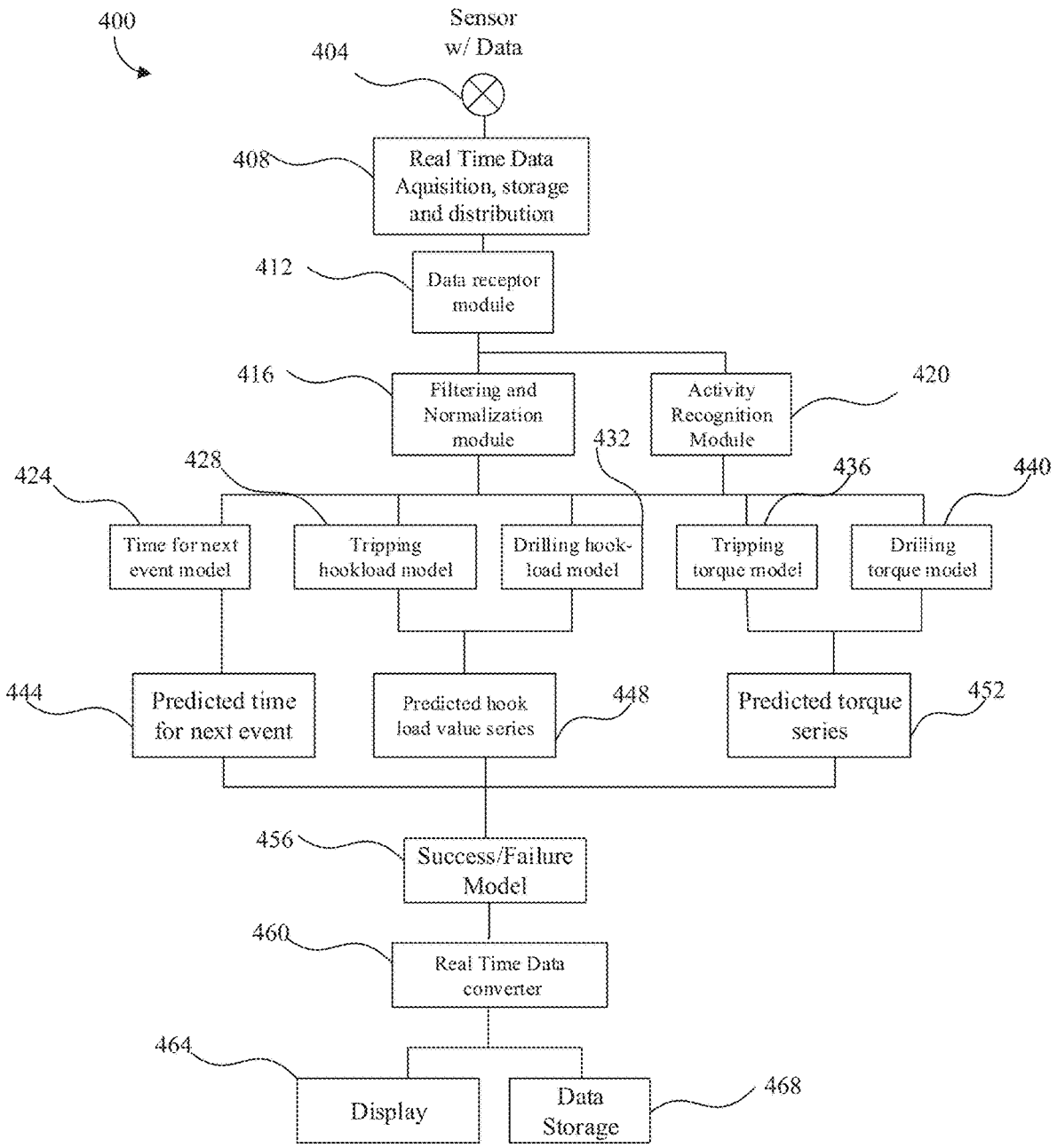
FIG. 4 is a machine learning system for predicting a differential sticking event.

With reference to FIG. 4, a system 400 for predicting differential sticking is illustrated. In some embodiments, the system 400 executes or performs the method 300 or a similar method. The system 400 includes sensors 404 that are coupled to rig equipment or downhole tools. The sensors 404 are coupled to the drilling rig 100 and provide time-based data that is captured by a real-time data system 408 including storage and distribution. In some embodiments, the real-time data system 408 includes wellbore trajectory data from real time sensors or planned data. The sensor 404 describes operation of the drill rig 100, including but not limited to, hook load (i.e., the weight of the string 112), position (e.g., the position of the string 112), torque (i.e., the force used to rotate the string 112), rpm (i.e., the number of rotations per minute applied to the drill string 112), pump pressure and flow rate (i.e., the output values from the pump 108C). The sensor 404 may also be connected to the downhole string 112, either providing measurements on the rig operations, such as load, torque, rpm, flowrate, pump pressure or sensors measuring the properties of the downhole formations including GR, Neutron Density data, Sonic response data and others). The systems and methods of the present invention also support the use of derived or modelled data related to the wellbore, including but not limited to bit depth, load data on components in the well, pressure profiles in mud and/or formations, temperature profiles in mud and/or formation. The output of torque and drag models or hydraulic models are typical examples.

With continued reference to FIG. 4, the system 400 further includes a data receptor module 412 that connects to the data source and configuration of data mnemonics for the relevant sensor data series. In some embodiments, each different data format includes a corresponding unique data receptor module. A filtering and normalization module 416 and an activity recognition module 420 that perform pre-processing on the data received by the data receptor module 412 (e.g., STEPS 316, 318).

The rig state recognition module 420 may determine a start time and a stop time of an operation. In some embodiments, the rig state recognition module 420 includes the following: first, identifying the start and end time as the time of changed sign on the block position when hook load is above a configurable threshold value; second, start time of a rig state identified as first change of sign on the derivative of the hook load and or torque after a maximum value; and third, identify start point as the first hook load or torque maximum value after a relatively large configurable value change in block position value and end point as the time when a relatively large drop in hook load or torque occurs together with an upward movement of the block positions. In some embodiments, similar types of start and stop calculations use a combination of hook load and/or block position and/or torque/rpm combinations. The filtering mechanism identify the hook load or torque value and time for the first minimum and/or maximum value for each pipe cycle after onset of operation.

For example, when the operation state is a circulating state, the start time of the operation state and the end time of the operation state are identified as the time when a flow-in sensor value is above a threshold value. For example, when the operation state is a drilling state, the start time of the operation state and the end time of the operation state are identified as the time of a direction change of the block position and when hook load is above a threshold value. In another example, when the operation state is a drilling state, the start time of the operation state is identified as the first sign change of the derivative of the hook load or torque after a maximum value. In another example, when the operation state is a drilling state, the start time of the operation state is identified as the first hook load or torque maximum value after a predetermined change in block position value, and the end time of the operation state is identified as a drop in hook load or torque in combination with upward movement of the block position.

With continued reference to FIG. 4, the system 400 further includes a plurality of predictive models 424, 428, 432, 436, 440 for predicting sensor values. With the filtering and operation state detection, the input to the machine learning models 424, 428, 432, 436, 440 in one embodiment is a first minimum sensor value after the start of the operation state. In other embodiments, the input to the machine learning models 424, 428, 432, 436, 440 is a first maximum sensor value after the start of the operation state. In another embodiment, the input to the machine learning modules 424, 428, 432, 436, 440 is an average sensor value after the start of the operation state.

Each of the predictive models 424, 428, 432, 436, 440 are designed and trained for a specific rig activity. Model 424 predicts the timing for a next event, model 428 predicts tripping hook load, model 436 predicts drilling hook load, model 426 predicts tripping torque, and model 440 predicts drilling torque. These models may be Artificial Neural Network (ANN) models, regression models or other predictive machine learning models. The operating state identified by the activity recognition module 420 may determine, in part, which predictive models are used. In other words, the preferred prediction can be based on the operational state. The corresponding prediction outputs from the predictive models 424, 428, 432, 436, 440 include a predicted time for a next event 444, a predicted hook load value series 448, and a predicted torque series 452. In other embodiments, the machine learning models predicts Equivalent Circulating Density (ECD) values based on filtered Equivalent Circulating Density (ECD) sensor values. In some embodiments, the time of next event prediction module 424 uses a multi-step forecasting model that predicts the time for the next filtered minimum or maximum sensor value (torque or hook load).

Figure 10:
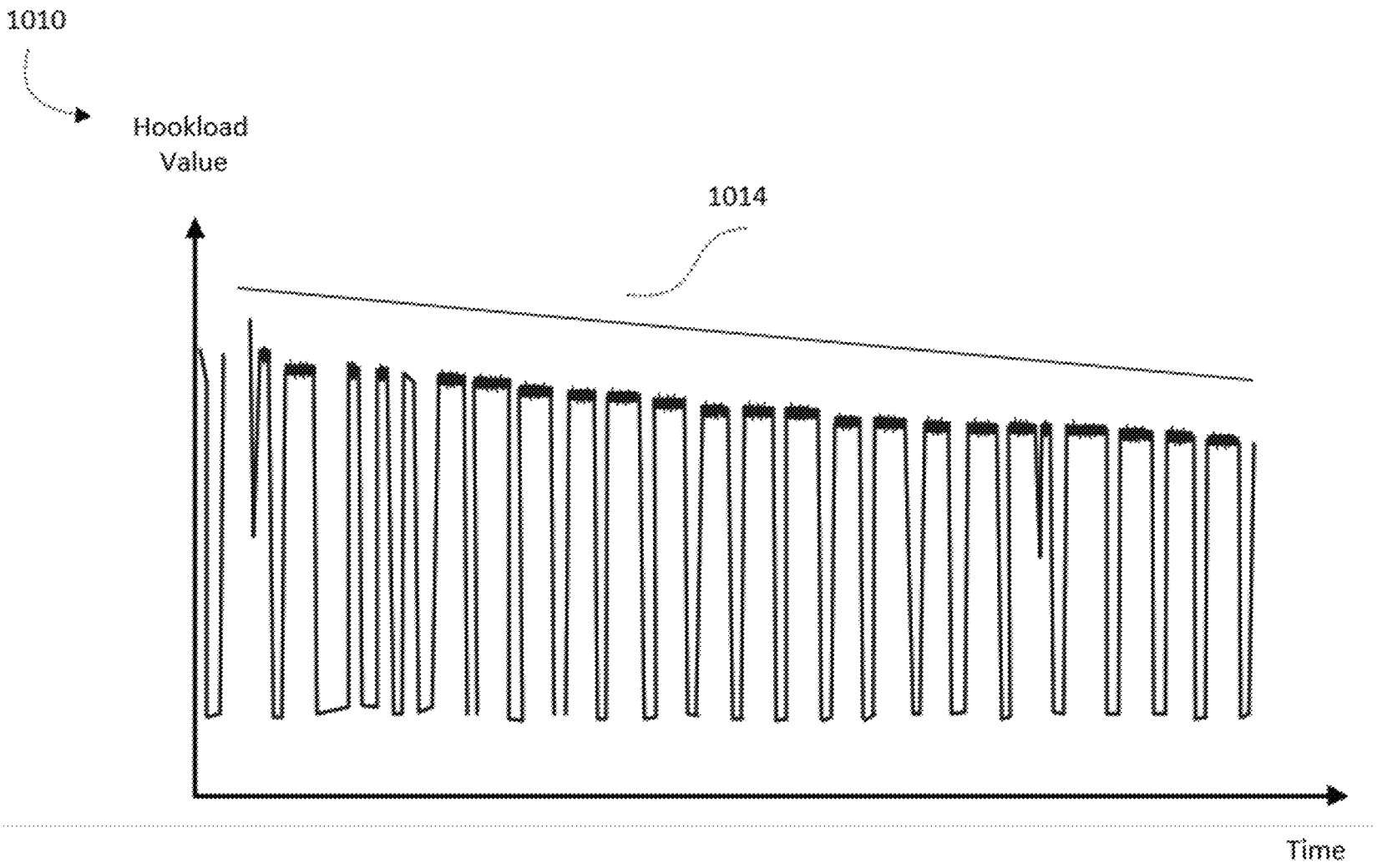
FIG. 10 is a graph illustrating hook load values of a period of time, illustrating a decreasing value trend corresponding to removing a pipe from the wellbore.

With continued reference to FIG. 4, the system 400 includes a success or failure model (i.e., a trigger threshold) 456. The trigger threshold 456 is a rule-based success failure model, where the threshold values are configurable and can be dependent upon the activity being performed. Generally, both hook load and torque values change as a function of pipe length. Longer pipe require more force to move the pipe, resulting in higher values. FIG. 10 illustrates an example hook load curve 1010 where the long-term trend 1014 is decreasing, thus representative of removing pipe from the wellbore.

With reference to the system 400, the trigger threshold 456 may include the following rules. First, a warning is issued when the predicted torque or hook load value multiplied by a first value show number of a second value in sequence with an opposing general trend than expected from the activity. For example, following the trend illustrated in FIG. 10, a warning would be generated if the predicted torque or hook load values show an increasing trend. In other words, the event of differential sticking is predicted when the prediction satisfies the trigger threshold when the prediction trend is opposite of an expected trend.

Second, the trigger threshold 456 may include an alarm provided in case of a third value of warnings follow in sequence. Third, the trigger threshold 456 may include a warning is provided if the actual minimum or maximum value is delayed with more than a fourth configurable value of minutes after the predicted time for a minimum or maximum value. In some embodiments, the predicted data values and warnings and alarms scenario are converted to time series data and visualized in a computer user interface.

With continued reference to FIG. 4, the system 400 includes a real time data converter 460, a display 464, and data storage 468. In some embodiments, the predicted data values and likelihood for meeting the success/failure scenario (trigger threshold) are converted to time or depth series data and stored in a database or memory. In other words, the predictions are stored in a database and the comparison results between the trigger threshold and the predictions are stored in a database. In some embodiments, the predicted data values and warnings and alarm scenarios are converted to time series data by the real time data converter 460 and visualized in a computer user interface (e.g., the display 464). In other words, the time prediction, the value prediction, and the comparison with the trigger threshold are shown on the display 464. In some embodiments, the predicted data values and likelihood for meeting the trigger threshold are converted to time or depth series data and is stored in the database 468. Every prediction is stored with a time stamp for when the prediction was done such that the predictions create a time series of data. For example, a first data point includes a first prediction value and a first time and a second data point includes a section prediction value and a second time. A depth series log is generated by finding the bit or hole depth at the time of the prediction. If at the first time, the depth was a first depth what is then stored for the first data point after conversion is the first prediction value and the first depth.

Figure 5:
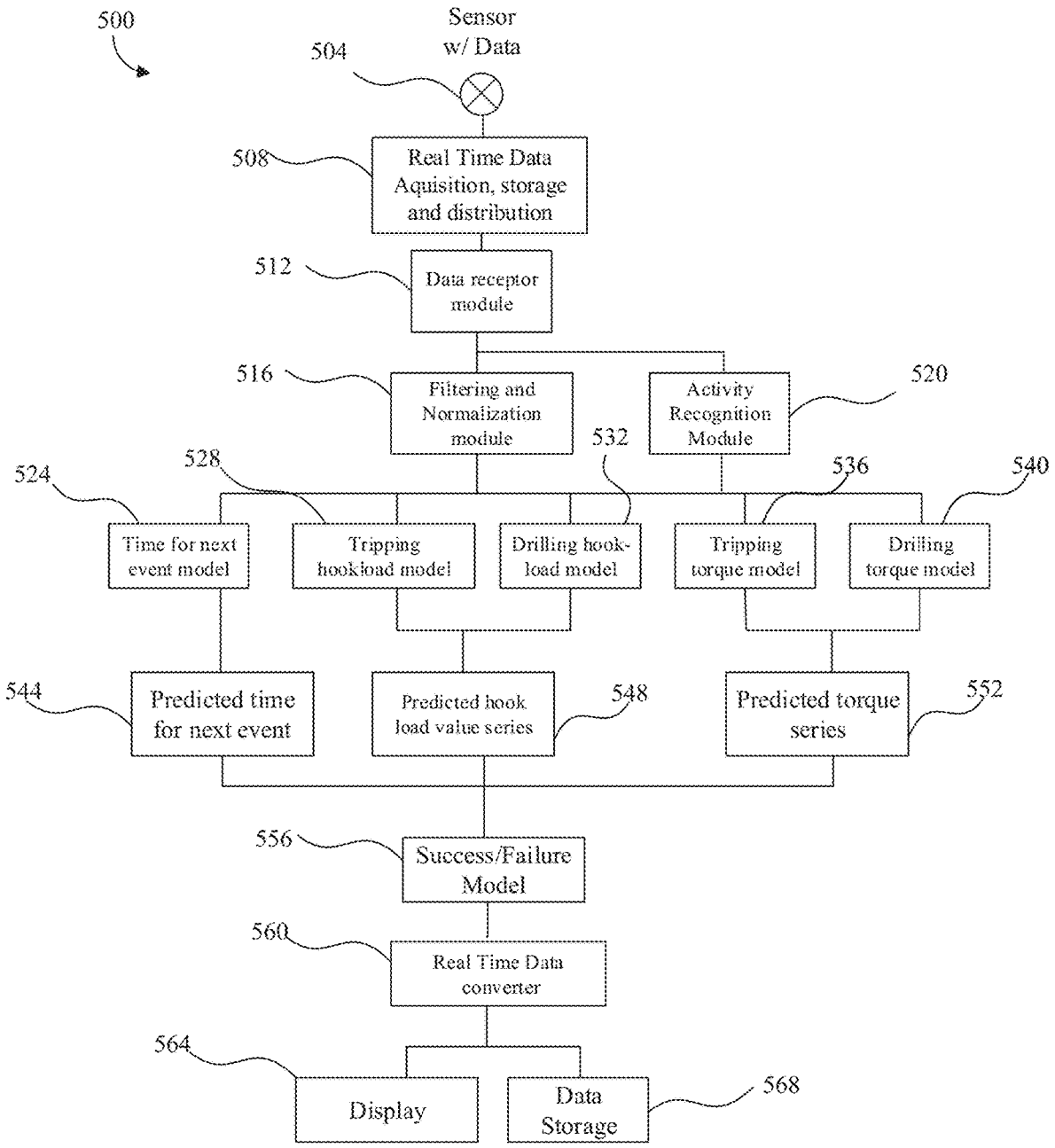
FIG. 5 is a machine learning system for predicting a wellbore geometry issue event.

With reference to FIG. 5, a system 500 is utilized for predicting wellbore geometry issue (FIG. 2B). The system 500 is similar to the system 400 with similar reference numerals used to identify similar components. The data series relevant for the wellbore geometry prediction models 524, 528, 532, 536, 540 are hook load, block position, torque, RPM, flow-rate, bit depth, hole depth, wellbore trajectory, and hole size. In some embodiments predicting wellbore geometry, the filtering mechanism 516 identifies hook load and torque values and time for the minimum and or maximum value for the entire pipe cycle. In other embodiments, the input to the models is the minimum value during lowering or hoisting a length of pipe. In other embodiments, the input is the average value during lowering or hoisting a length of pipe.

For predicting wellbore geometry issues, the following trigger thresholds (i.e., success/failure models 556) may be utilized: a warning is provided if the predicted torque or hook load value multiplied by a first value show a number of second value in sequence with an opposing general trend than expected from the activity, and wherein there is a deviation ratio (dogleg) in the wellbore with a third value higher than a fourth value near the bit. In other words, when the event is wellbore geometry issues, the prediction satisfies the trigger threshold when the prediction trend is opposite of an expected trend and a dogleg in the wellbore is higher than a predetermined threshold.

Figure 6:
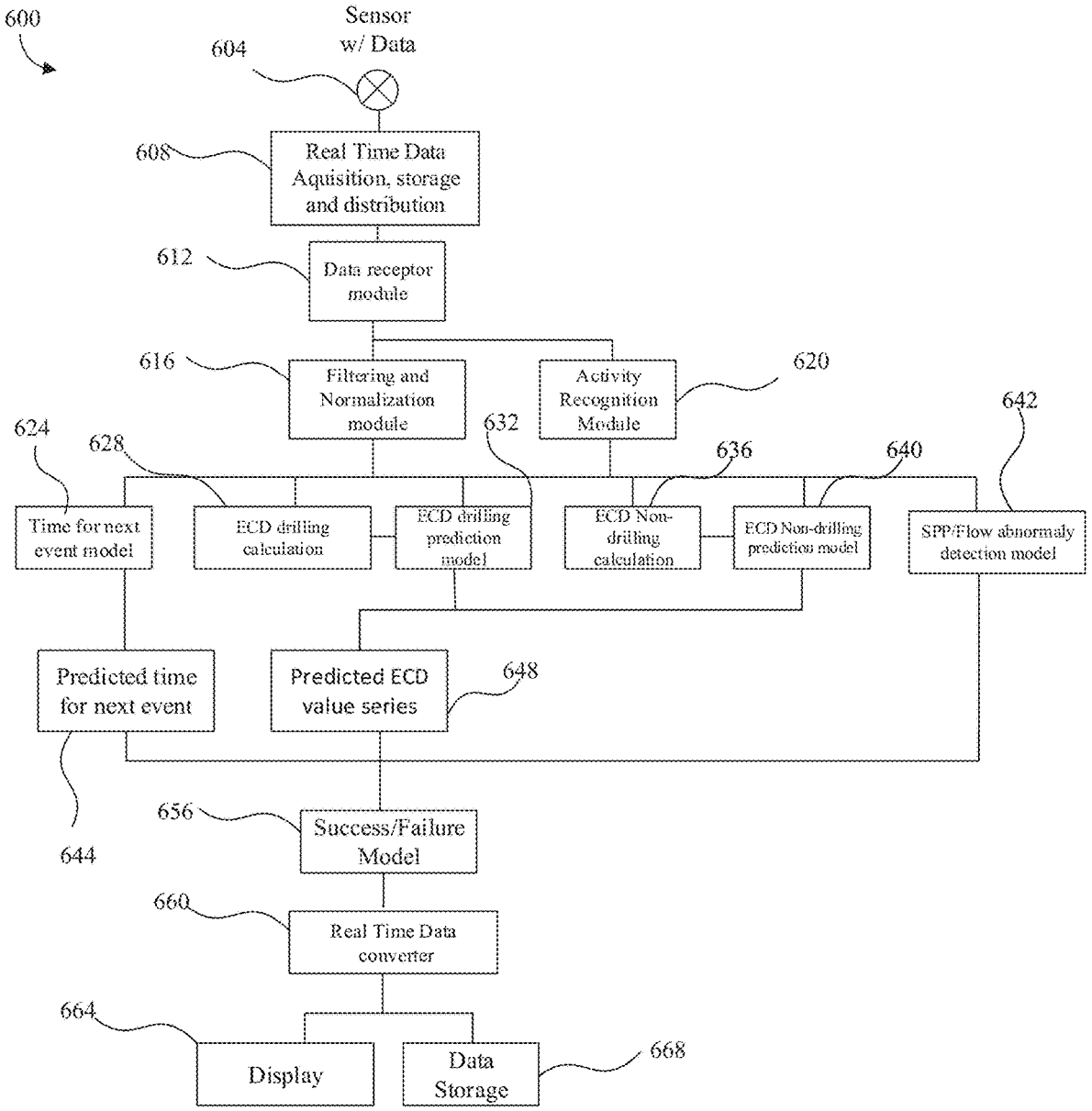
FIG. 6 is a machine learning system for predicting a hole cleaning event.

With reference to FIG. 6, a system 600 is utilized for predicting hole cleaning issues (FIG. 2C). Similar to being able to make accurate predictions when there is a risk for getting the pipe stuck, there is value to be able to accurate predict when there is a risk for poor hole cleaning. In situations with pool hole cleaning (FIG. 2C) cuttings accumulate in the well, causing flow restrictions in the well. The system 600 implements the method 300 or other similar methods for predicting accumulations of cuttings in the well, thereby being able to provide warnings for increased risk of getting stuck due to poor hole cleaning. The system 600 is similar to the system 400 with similar reference numerals used to identify similar components. The data series relevant for the wellbore geometry prediction models 624, 632, 640, 642 are hook load, block position, torque, RPM, flow rate, mud density in, standpipe pressure, bit depth, hole depth, and hole size.

Figure 12:
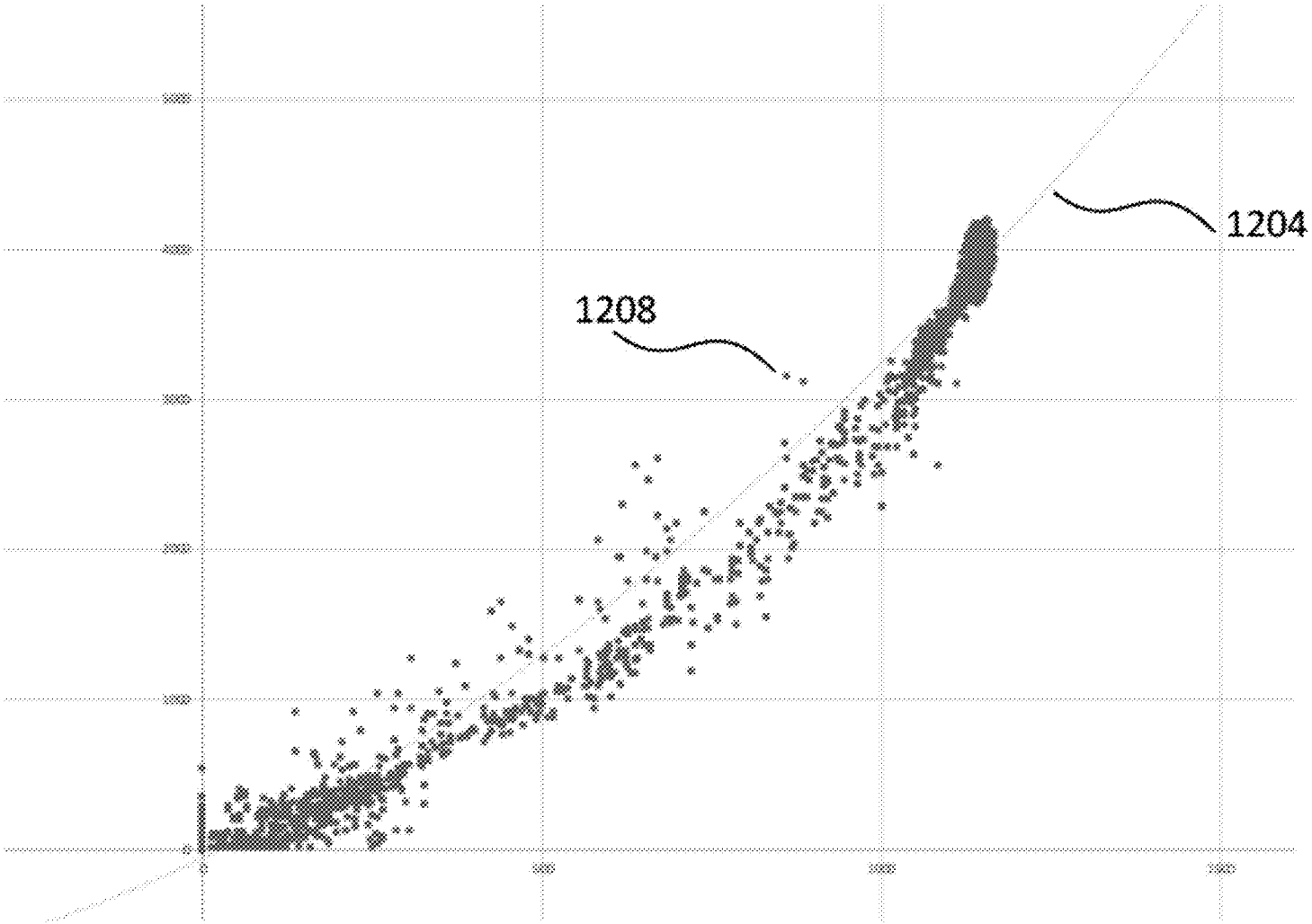
FIG. 12 is a graph illustrating SPP and flow value with a trendline.

The system 600 implements filtering and normalizing mechanism 616 where only sensor data corresponding to time stamps with flow rates having values exceeding a minimum. An additional filter mechanism, in some embodiments, discards crossplot SPP/flow values that deviate more than a configurable threshold value, from the previous non-discarded values. The activity recognition module 620 distinguishes between drilling and non-drilling activities. In some embodiments, the crossplot of SPP/flow value are calculated (FIG. 12), where SPP is the stand pipe pressure (i.e., pump pressure necessary to create a flow through the drill pipe and back up to the surface) and flow is the flow rate through the drill pipe. With reference to FIG. 12, a scatter plot 1200 of SSP/flow values forms a distinctive pattern from which a trendline 1204 is established. In other words, the relationship between flow and pressure is visualized with the trendline 1204. In cases of poor hole cleaning, the individual plotted value provides anomalous values 1208 deviating from the trendline 1204. Any deviation from the trendline 1204 signifies a change in conditions (e.g., more pressure is required to maintain the same flow in the case of poor hole cleaning). In one embodiment, a predictive model 642 predicting the crossplot SPP/flow ratio is used, and the predicted crossplot SPP/flow values are used by the trigger threshold model 656.

With continued reference to FIG. 6, if the Equivalent Circulating Density (ECD) is not known, the system 600 uses calculation modules 628 or 636 for drilling and non-drilling activities, respectively, for calculating the ECD values based on the sensor data input (e.g., mud density in, mud flow in, standpipe pressure, RPM, and bit depth). In some embodiments, the drilling calculation module 628 uses rate of penetration (ROP). The calculated ECD is then utilized by the ECD drilling and non-drilling prediction models 632, 640 to generate a predicated ECD value series 648.

For predicting hole cleaning issues, the following trigger thresholds (i.e., success/failure models 656) may be utilized: a warning is used when two or more consecutive predicted ECD values vary with more than a first threshold value. The drilling and the non-drilling ECD values are configurable independent of each other. In other words, when the event is hole cleaning failure, the prediction satisfies the trigger threshold when the variation between consecutive ECD predictions exceeds a threshold. In some embodiments, a warning is issued when the slope between two or more consecutive predicted ECD values varies with more than a second threshold value. In another embodiment, a warning is issued if one or more consecutive predicted crossplot SPP/flow values deviates more than a third threshold value from a calculated trend curve. In other words, when the event is hole cleaning issues, the prediction satisfies the trigger threshold when at least one prediction deviates from a trend. In another embodiment, an alarm is issued in the event of two ore more consecutive data points giving warnings.

Figure 11:
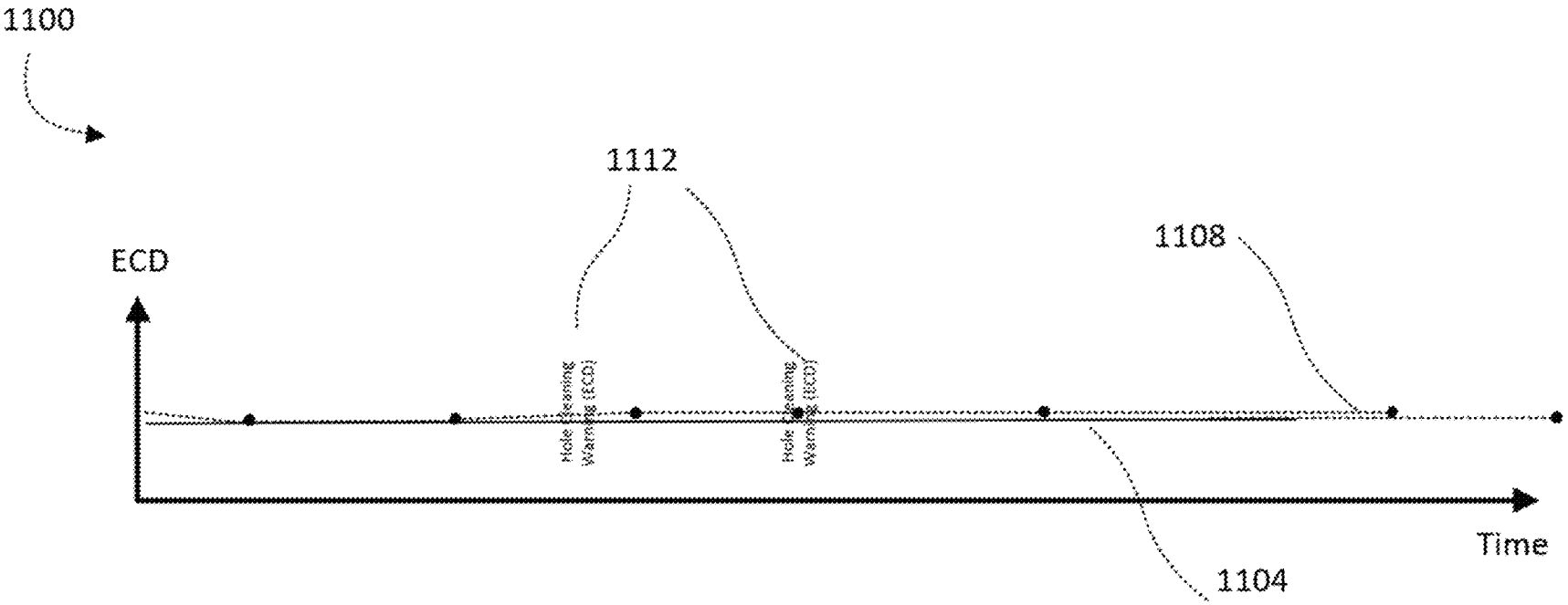
FIG. 11 is a user display illustrating predictive data values, warnings, and alarms.

In some embodiments, the predicted data values and the warnings and alarms scenarios are converted by a converter 660 to time series data and visualized in a computer user interface (i.e., display 646). An example of such a visualization is illustrated in FIG. 11, where the predicted data values and warnings are displayed in a time versus value plot 1100. The plot 1100 illustrated the calculated ECD curve 1104, predicted ECD curve 1108 and corresponding warnings 1112.

Figure 7:
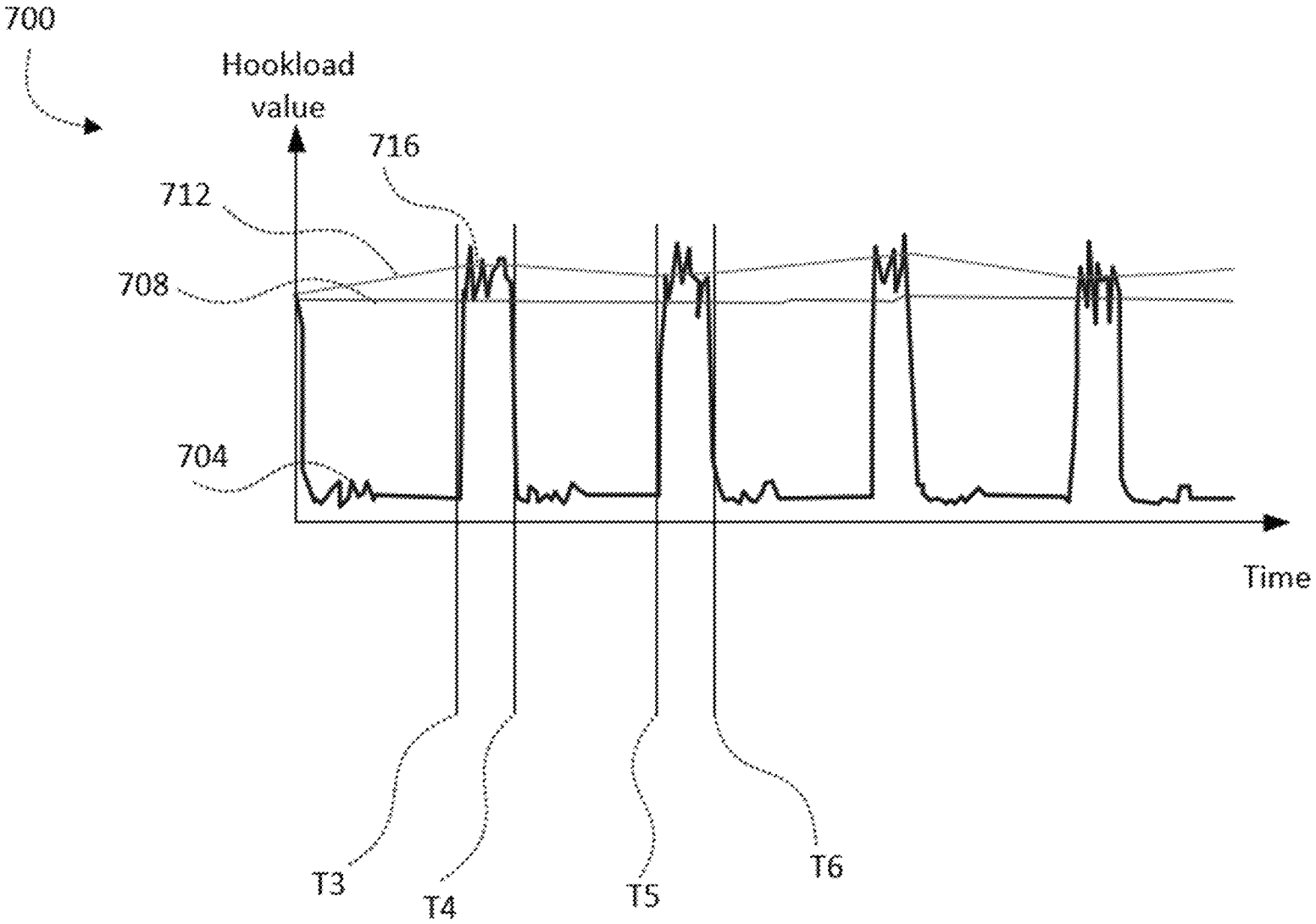
FIG. 7 is a graph illustrating hook load values as a function of time and the filtering of the hook load values.

With reference to FIG. 7, a graph 700 illustrates a curve 704 is representative of hook load as a function of time. In some embodiments, only portions of the curve 704 (i.e., partial data) is utilize for predictive modeling. For example, the period of time between T3 and T4 and the period of time between T5 and T6 is representative of the weight of the string 112. In contrast, the period of time between T4 and T5 is not useful for prediction of downhole events (e.g., the weight of the string is not carried by the hook). In other words, the sensor output data between T3-T4 and T5-T6 are hook load incidents, and can be further processed by using values (e.g., min, max, average, slopes, derived values, etc.) to be normalized. The time stamps for valid data boundaries (e.g., T3, T4, etc.) may also be used in some embodiments to filter other sensor output data. In other words, keeping only the valid data between times T3-T4 and T5-T6 for the other sensor output.

With continued reference to FIG. 7, a curve 708 illustrates a prediction curve for the minimum hook load in each of the active time intervals, and curve 712 illustrates a predicted maximum hook load curve for the same time internal. A point 716 illustrates the time for a predicted maximum value. In some embodiments, torque measurements values behave similarly to the hook load. Only hook load is illustrated in FIG. 7 for clarity.

Figure 8:
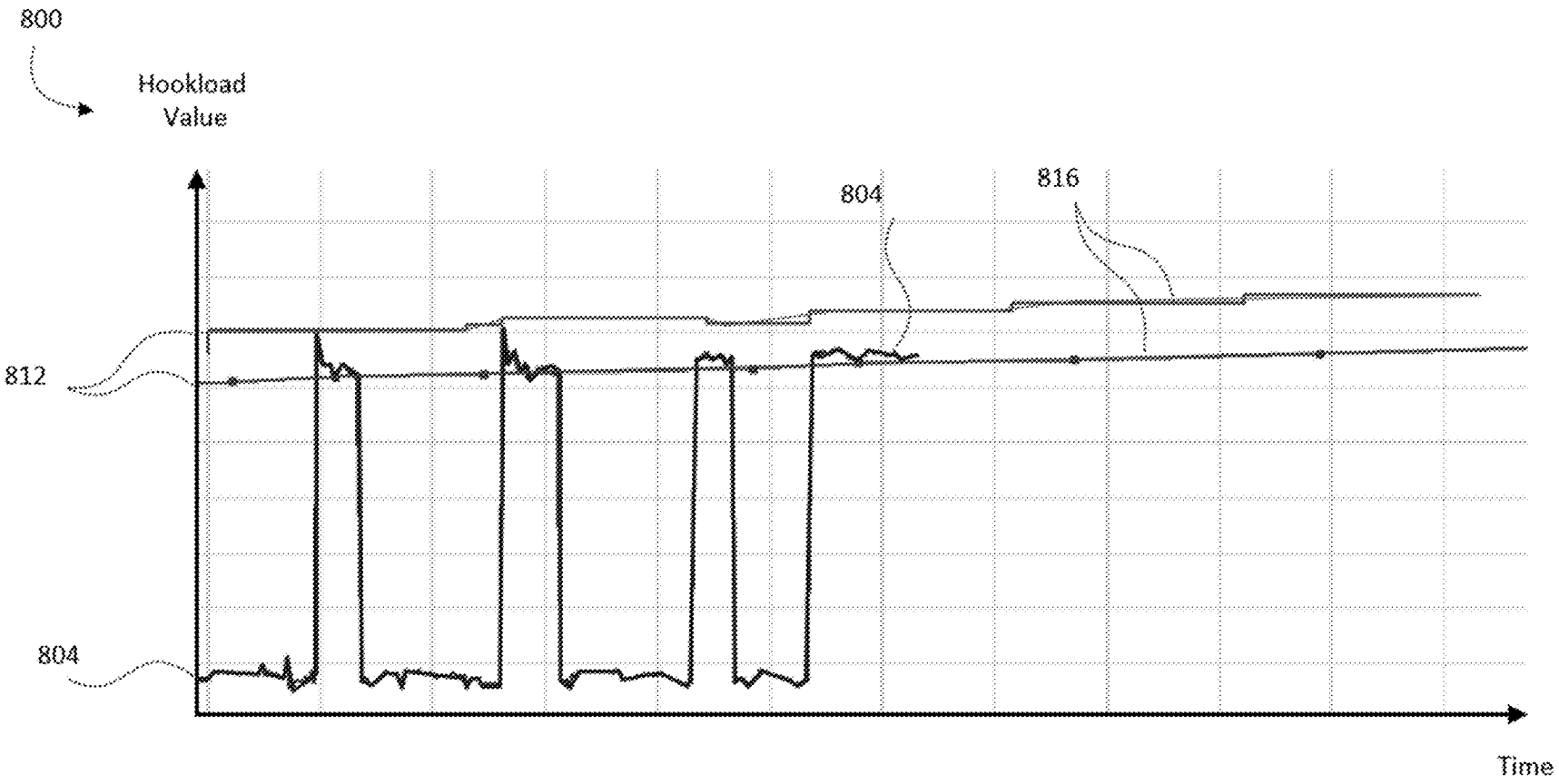
FIG. 8 is a graph illustrating a prediction of hook load values.

With reference to FIG. 8, a graph 800 of the outputs from the predictive models is illustrated with the time on the X-axis and hook load value on the Y-axis. Curve 804 illustrates the actual recorded hook load values and point 808 illustrates the actual time of recording (i.e., present time). Curves 812 illustrates the output of the predictive models as minimum and maximum hook load values, and points 816 illustrate the time for future, predicted values. In other words, the output of the predictive models provide a prediction for future values and timing of hook load. In other embodiments, the output of the predictive models predicts standpipe pressure and mud flow input values.

Figure 9:
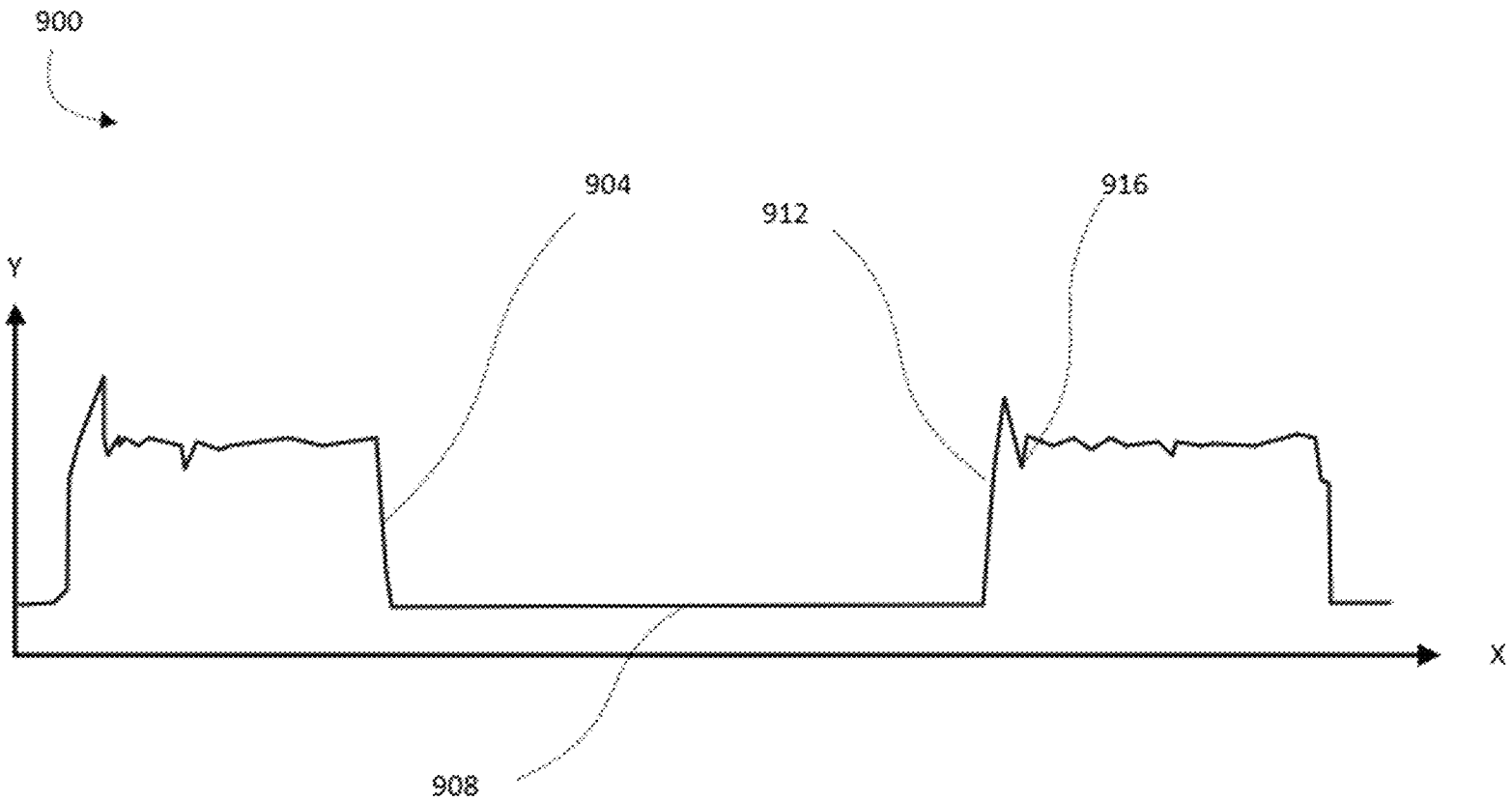
FIG. 9 is a graph illustrating hook load values as a function of time and portions related to a differential sticking event.

With reference to FIG. 9, a graph 900 illustrates hook load values as a function of time and portions related to a differential sticking event. Specifically, the actual hook load data illustrates the static friction created by hook load, which can be used to predict or infer differential sticking. Curve portion 904 shows the hook load when a stand is connected to the string and lowered into the wellbore, followed by the pickup up of a new stand of drill pipe during curve portion 908, and then a new stand of drill pipe is lowered into the wellbore 912. Curve portion 916 shows a reduced hook load as a result of static friction in the wellbore, which is known as a surface symptom of differential sticking when tripping in. Torque curves show similar curves, albeit only during activities where the pipe is rotating. Being able to make accurate predictions when there is a risk for getting differential stuck is valuable, as it allows qualified personnel to intervene early into the operations to secure a successful outcome of the operations. The disclosure provides herein methods and system for using machine learning systems to predict an increased risk for differential sticking, thereby allowing early interventions to prevent operational failure.

An indicator for differential sticking is high static friction, resulting in a low value anomaly 916 in the hook load curve when moving pipe downwards, and a similarly high value anomaly while pulling pipe up. Similar high friction anomalies will be observed when starting rotation. For moving pipe downwards, if the predicted minimum is below a pre-set threshold value which may be based on the last measured sensor value, a calculated minimum hook load value at a given depth or a combination of these, this is interpreted as an indication of anomalous static friction caused by differential sticking symptoms. For moving pipe upwards, the maximum predicted value is compared to a maximum threshold value based on the last measured value, calculated maximum hook load value or a combination of these. As differential sticking symptoms worsen with pipe standstill time, the predicted time for a minimum or maximum value to occur is also compared to the actual time of the predicted hook load incidents. In the event of a detected friction anomaly combined with an actual occurrence of a hook load incidents is delayed by more than a configurable threshold value, the risk for differential sticking is considered increased. The same logic as described for differential sticking is also applied for rotation. In other instances of the invention, similar time-series plots are predicted for flow rate, pump pressure, torque, rpm, ECD, pre-operation torque and drag analysis etc. These predictions are used to compare with other known industry pattern and trends.

Figure 13A:
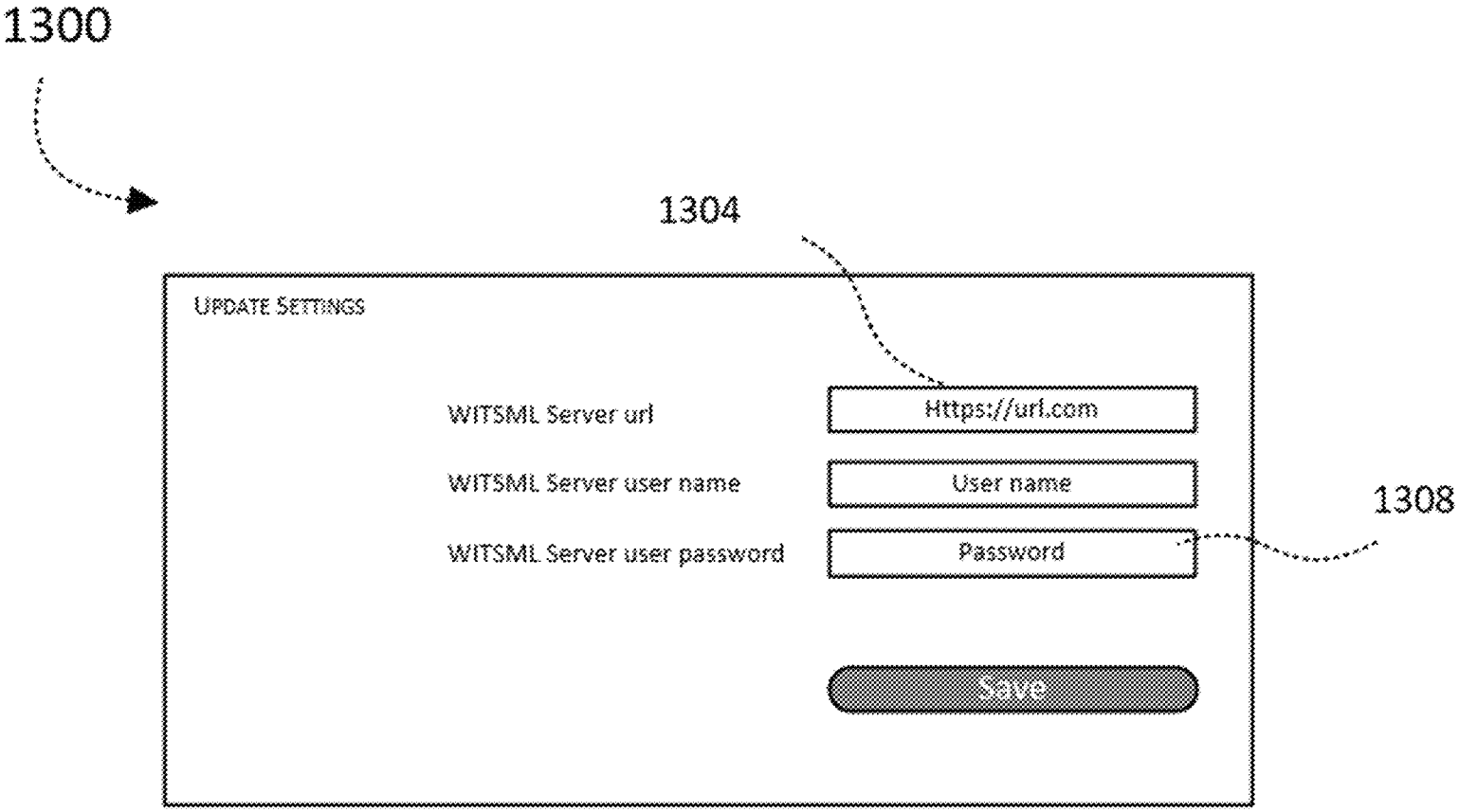
FIG. 13A is a first graphical user interface.
Figure 13B:
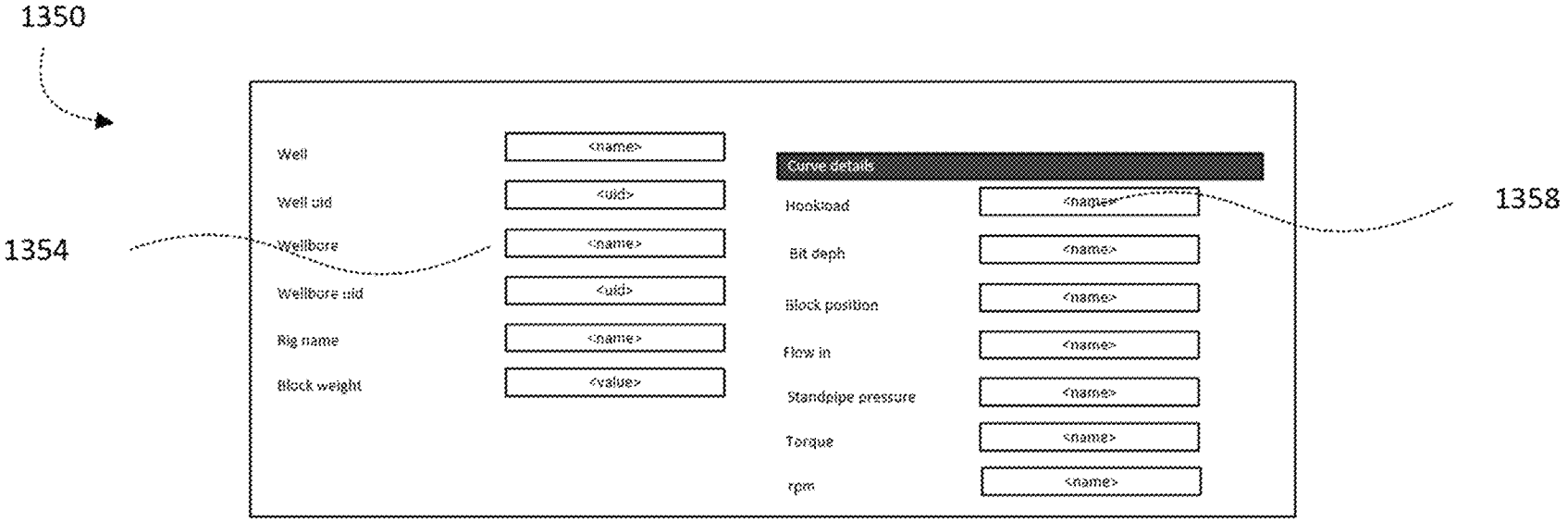
FIG. 13B is a second graphical user interface.

With reference to FIGS. 13A and 13B, a user interface for setting up (FIG. 13A) and configuring data mnemonics (FIG. 13B) for relevant sensor data series are illustrated. Different sources of such data can be WITSML data, WITSO, OPC data or other data formats. The data receptor module is an integration service that is tailored to the source, using known system integration methodologies, in the case of WITSML, the receptor module uses xml-queries via a SOAP interface; for OPC-UA a RestAPI is used. With reference to FIG. 13A, a user with a graphical user interface 1300 is able to set up the data receptor to retrieve data from a specific server 1304 and also supporting log-in security requirements 1308. With reference to FIG. 13B, a graphical user interface 1350 permits a user to configure the wellbore names 1354, used by the receptor module to retrieve the correct data, and to select the appropriate data sources 1358 for the machine learning module. The data series relevant for the differential sticking model are hook load, block position, torque, RPM, flow-rate, bit depth, hole depth, and hole size.

In some embodiments, the method and systems described herein utilized a plurality of sensors in combination. For example, a plurality of sensors can be connected to the same Real Time Data Acquisition, storage and distribution. Examples of different data formats includes, but are not limited to WITSML, WITS, OPC-(UA), ASCII etc. In some embodiments, filtering data from one sensor can be used by another filtering and normalization module. In other words, a predictive model can be run on a singular sensor input, as for the examples used for hook load, or more than one sensor, where the sensor value has a dependency of one or more other sensor values. An example of this is torque and pump pressure predictions, where both the torque and rpm and pump pressure and flow rates are used to predict torque and rpm values. A trigger threshold can be using input from one sensor, or two or more sensors based on the requirements for the specific success/failure model. For example, with differential sticking prediction during drilling operations, both torque and hook load have characteristic static friction profiles like the profile seen in FIG. 9.

Various features and advantages are set forth in the following claims.

What is claimed is:

1. A method for predicting an event in oilfield operations, the method comprising:

receiving time-based data from a real-time data system including a sensor;

filtering the time-based data from the sensor;

identifying an operation state based on the time-based data from the sensor;

generating, using a machine learning model, a prediction based on the filtered time-based data from the sensor, wherein the prediction includes a predicted future time and a predicted value;

visualizing on a display the predicted future time and the predicted value;

comparing the prediction with a trigger threshold to predict when the event will occur;

generating a warning that the event may happen when the prediction satisfies the trigger threshold; and intervening with a mitigating action in the oilfield operations to avoid the event.

2. The method of claim 1, wherein the sensor is coupled to a portion of an oil well, and the sensor is selected from the group of a hook load sensor, a torque sensor, mud density input sensor, a mud flow input sensor, a pressure sensor, a RPM sensor, an Equivalent Circulating Density (ECD) sensor, a Rate of Penetration (ROP) sensor, and a bit depth sensor.

3. The method of claim 1, wherein the real-time data system includes wellbore trajectory data from real time sensors or planned data.

4. The method of claim 1, wherein the step of receiving time-based data is at a processor remote from the oil well.

5. The method of claim 1, wherein the operation state is selected from the group of a drilling state, a tripping-in state, a tripping-out state, a reaming state, a sliding state, and a circulating state.

6. The method of claim 1, wherein the operation state is a circulating state and a start time of the operation state and an end time of the operation state are identified as the time when a flow-in sensor value is above a threshold value.

7. The method of claim 1, wherein the operation state is a drilling state, and a start time of the operation state and an end time of the operation state are identified as the time of a direction change of the block position and when hook load is above a threshold value.

8. The method of claim 1, wherein the operation state is a drilling state, and a start time of the operation state is identified as the first sign change of the derivative of the hook load or torque after a maximum value.

9. The method of claim 1, wherein the operation state is a drilling state, and a start time of the operation state is identified as the first hook load or torque maximum value after a predetermined change in block position value, and an end time of the operation state is identified as a drop in hook load or torque in combination with upward movement of the block position.

10. The method of claim 6, wherein an input to the machine learning model is a minimum sensor value after the start of the operation state.

11. The method of claim 6, wherein an input to the machine learning model is a maximum sensor value after the start of the operation state.

12. The method of claim 6, wherein an input to the machine learning model is an average sensor value for a period of time after the start of the operation state.

13. The method of claim 1, wherein the machine learning model is a first machine learning model and the prediction is a first prediction, and wherein the method further includes generating, using a second machine learning model, a second prediction based on the filtered time-based data from the sensor, wherein the second prediction includes a time and a value; and wherein the method further includes determining a preferred prediction from the first prediction and the second prediction and a corresponding preferred machine learning model from the first machine learning model and the second machine learning model.

14. The method of claim 13, wherein the preferred prediction is based on the operational state.

15. The method of claim 13, wherein the preferred machine learning model calculates Equivalent Circulating Density (ECD) values.

16. The method claim 13, wherein the preferred machine learning model predicts Equivalent Circulating Density (ECD) values based on filtered Equivalent Circulating Density (ECD) sensor values.

17. The method of claim 13, wherein the preferred machine learning model predicts standpipe pressure and mud flow input values.

18. The method of claim 1, wherein the prediction is stored in a database.

19. The method of claim 1, wherein the comparison results between the trigger threshold and the prediction are stored in a database.

20. The method of claim 1, wherein the method assesses future drilling risks by the use of a success/failure model.

21. A system for predicting an event in oilfield operations comprising:

a real time data system including at least one sensor associated with at least one oil well;

a display remote from the oil well;

an electronic processor and a memory, the memory storing instructions that when executed by the electronic processor configure the electronic processor to:

receive data from the real time data system;

identify an operation state based on the data received from the real time data system;

filter the data received from the real time data system;

generate a future time prediction and a value prediction using a machine learning model based on the filtered data;

display the future time prediction and the value prediction on the display;

compare the future time prediction and the value prediction with a trigger threshold to predict when the event will occur; and display on the display a warning that the event may happen when the prediction satisfies the trigger threshold.

22. The system of claim 21, wherein the system further includes a network through which the data from the real time data system is received by the electronic processor.

23. The system of claim 21, further including a database and wherein the time prediction, the value prediction, and the comparison with the trigger threshold are stored in the database.

24. The system of claim 21, wherein the electronic processor is configured to receive data from the real time data system data from at least at least two sensors.

25. The system of claim 21, wherein the time prediction is a first time prediction, the value prediction is a first value predication, and the machine learning model is a first machine learning model, and wherein the electronic processor is configured to generate a second time prediction and a second value prediction using a second machine learning model based on the filtered data.

26. The system of claim 25, wherein the electronic processor is configured to select a preferred prediction.

* * * * *